US008162182B2

(12) United States Patent
Martindale

(10) Patent No.: US 8,162,182 B2
(45) Date of Patent: Apr. 24, 2012

(54) BEVERAGE DISPENSING APPARATUS WITH PROTECTIVE CLADDING

(75) Inventor: Richard A. Martindale, Vacaville, CA (US)

(73) Assignee: Automatic Bar Controls, Inc., Vacaville, CA (US)

( * ) Notice: Subject to any disclaimer, the term of this patent is extended or adjusted under 35 U.S.C. 154(b) by 486 days.

(21) Appl. No.: 12/337,537

(22) Filed: Dec. 17, 2008

(65) Prior Publication Data

US 2010/0147886 A1 Jun. 17, 2010

(51) Int. Cl.
*B67D 5/66* (2006.01)

(52) U.S. Cl. ..... 222/144.5; 222/113

(58) Field of Classification Search ..... 222/144.5, 222/113, 129.1, 23
See application file for complete search history.

(56) References Cited

U.S. PATENT DOCUMENTS 3,168,967 A * 2/1965 Giampa ..... 222/129.1
3,241,720 A * 3/1966 Walter ..... 222/23
3,703,187 A * 11/1972 Booth ..... 137/114
4,619,378 A * 10/1986 de Man ..... 222/144.5
4,921,140 A 5/1990 Belcham
4,986,449 A * 1/1991 Valiyee et al. ..... 222/144.5
5,056,686 A 10/1991 Jarrett
5,435,466 A * 7/1995 Du ..... 222/108
7,028,864 B2 4/2006 McCann
7,267,247 B1 9/2007 Crunkleton
7,658,006 B2 * 2/2010 Schroeder ..... 29/890.142
7,931,382 B2 * 4/2011 Hecht ..... 362/96
2009/0114680 A1 * 5/2009 Williams et al. ..... 222/144.5

* cited by examiner

*Primary Examiner* — Kevin P Shaver
*Assistant Examiner* — Donnell Long
(74) *Attorney, Agent, or Firm* — Kilpatrick Townsend & Stockton LLP

(57) ABSTRACT

A bar gun handle having a housing assembly including an inlet in fluid communication with a valve bore, an outlet in fluid communication with the valve bore and in further fluid communication with an output nozzle, a valve element operatively mounted in the valve bore to control the flow of fluid from the inlet to the output nozzle, with an actuator coupled to the valve element, and a cladding layer disposed on a side of the bar gun handle that substantially covers the side of the bar gun handle. The present invention also includes a kit used to provide a protective cladding to a bar gun handle.

9 Claims, 3 Drawing Sheets

BEVERAGE DISPENSING APPARATUS WITH PROTECTIVE CLADDING

BACKGROUND OF THE INVENTION

The present invention relates to beverage dispensers, and more specifically to providing a protective cladding to the beverage dispenser, or portions thereof.

Hand held bar guns that mix liquids from several sources into one beverage or dispense pre-mixed beverages are known in the restaurant industry. One such bar gun system is described in the assignee's U.S. Pat. No. 4,986,449, entitled: "Beverage Dispensing Apparatus," the disclosure of which is incorporated by reference herein. Bar guns are typically used for beverages, such as soft drinks, that do not need to be mixed prior to dispensing or are already mixed. Bar guns typically contain valves and fluid passageways that convey liquids to a point where they are mixed just prior to being dispensed. However, the existing bar guns and handles are prone to damage from the rough handling they may receive in a typical busy bar or restaurant environment. Furthermore, existing bar guns and handles miss an opportunity for the promotion or branding of dispensed beverages.

There is therefore a need for a bar gun or a beverage dispensing handle which is protected from rough handling and is less prone to damage. Furthermore, there is a need for such a bar gun or beverage dispensing handle that can be used as a branding or advertising vehicle.

BRIEF SUMMARY OF THE INVENTION

The present invention is directed toward a hand-held beverage dispensing device with a protective cladding layer, for example, a bar gun or a beverage dispensing handle. Such a bar gun or a beverage dispensing handle can be used to improve durability, to enhance brand identification, to increase the attraction of a particular beverage, and for novelty purposes. The protective cladding layer may be placed on the bar gun or beverage dispensing handle to prevent damage to the bar gun or beverage dispensing handle from rough handling during operation. Different types of protective cladding, for instance colored cladding, may be placed on the enhanced bar gun or the enhanced beverage dispensing handle housing. Such colored cladding may be used to enhance brand identification of the beverages being dispensed, or for novelty purposes.

In one embodiment, the present invention provides a bar gun handle having a housing assembly, the housing assembly including inlets, valve bores, outlets, an output nozzle, valve elements, and valve actuators for controlling the flow of liquids from the inlets to the output nozzle. The bar gun handle also has a cladding layer disposed on at least one side of the housing assembly, the cladding layer substantially covering the at least one side of the housing assembly.

In one aspect, the thickness of the cladding layer increases from the top, front, and bottom edges to a constant value. For example, the top, front, and bottom edges may be beveled or rounded over, to eliminate the sharp edges of the cladding layer. In another aspect, the top edge of the cladding layer may be substantially perpendicular to the rear edge of the cladding layer and substantially non-perpendicular to the front edge of the cladding layer. The bottom edge of the cladding layer may also contain a step which may be arcuate in shape. This arrangement of the edges allows the cladding layer to conform to the shape of the underlying bar gun handle.

In another aspect, the cladding layer is disposed on at least two sides of the housing assembly. In yet another aspect, the cladding layer can be made of acrylic, acrylonitrile butadiene styrene, rubber, or combinations thereof. In yet another aspect, the housing assembly is made from a different material than the cladding layer. In yet another aspect, the cladding layer is bonded to the housing assembly using an adhesive, a solvent, an ultrasonic weld, or combinations thereof.

In yet another aspect, the cladding layer can be transparent, such that light from a lighting source within the bar gun handle or the cladding layer may be seen through the cladding layer. In yet another embodiment, the cladding layer can be translucent, such that light from a lighting source within the bar gun handle or the cladding layer may be seen through the cladding layer, while at the same time obscuring the internal mechanism of the bar gun handle. In yet another embodiment, the cladding layer may be at least one opaque color, such that the color can be used for purposes such as beverage branding or other suitable purposes.

In yet another aspect, the cladding layer may be shaped to have contour with enhanced grip. For example, the cladding layer may have beveled or rounded edges such that the bar gun handle is more comfortable for an operator to hold. As another example, the cladding layer may contain ridges and grooves that are shaped to be complementary to an operator's fingers, again allowing for a more comfortable grip. With the added comfort, it can be easier for an operator to maintain his grip on the bar gun handle.

In another embodiment, the present invention provides a kit for retrofitting a cladding layer onto a bar gun. The kit includes at least one cladding element, the cladding element configured to substantially cover at least one side of the bar gun. The kit can further include a bonding agent, wherein the bonding agent is used to adhere the cladding element to the side of the bar gun.

In one aspect, the thickness of the cladding element increases from the top, front, and bottom edges to a constant value. For example, the top, front, and bottom edges may be beveled or rounded over, to eliminate the sharp edges of the cladding element. In another aspect, the top edge of the cladding element may be substantially perpendicular to the rear edge of the cladding element and substantially non-perpendicular to the front edge of the cladding element. The bottom edge of the cladding element may also contain a step which may be arcuate in shape. This arrangement of the edges allows the cladding element to conform to the shape of the underlying bar gun handle.

In another aspect, the kit includes at least two cladding elements. In yet another aspect, the cladding element is made of an acrylic, acrylonitrile butadiene styrene, rubber, or combinations thereof. In yet another aspect, the cladding element is made from a different material than the bar gun. In yet another aspect, the bonding agent is an adhesive, a solvent, an ultrasonic weld, or combinations thereof.

In yet another aspect, the cladding element can be transparent, such that light from a lighting source within the bar gun handle or the cladding element may be seen through the cladding element. In yet another embodiment, the cladding element can be translucent, such that light from a lighting source within the bar gun handle or the cladding element may be seen through the cladding element, while at the same time obscuring the internal mechanism of the bar gun handle. In yet another embodiment, the element layer may be at least one opaque color, such that the color can be used for purposes such as beverage branding or other suitable purposes.

In yet another aspect, the cladding element may be shaped to have contour with enhanced grip. For example, the cladding element may have beveled or rounded edges such that the bar gun handle is more comfortable for an operator to hold. As another example, the cladding element may contain ridges and grooves that are shaped to be complementary to an operator's fingers, again allowing for a more comfortable grip. With the added comfort, it can be easier for an operator to maintain his grip on the bar gun handle.

For a further understanding of the nature and advantages of the invention, reference should be made to the following description taken in conjunction with the accompanying figures. It is to be expressly understood, however, that each of the figures is provided for the purpose of illustration and description only and is not intended as a definition of the limits of the embodiments of the present invention.

DETAILED DESCRIPTION OF THE INVENTION

Figure 1:
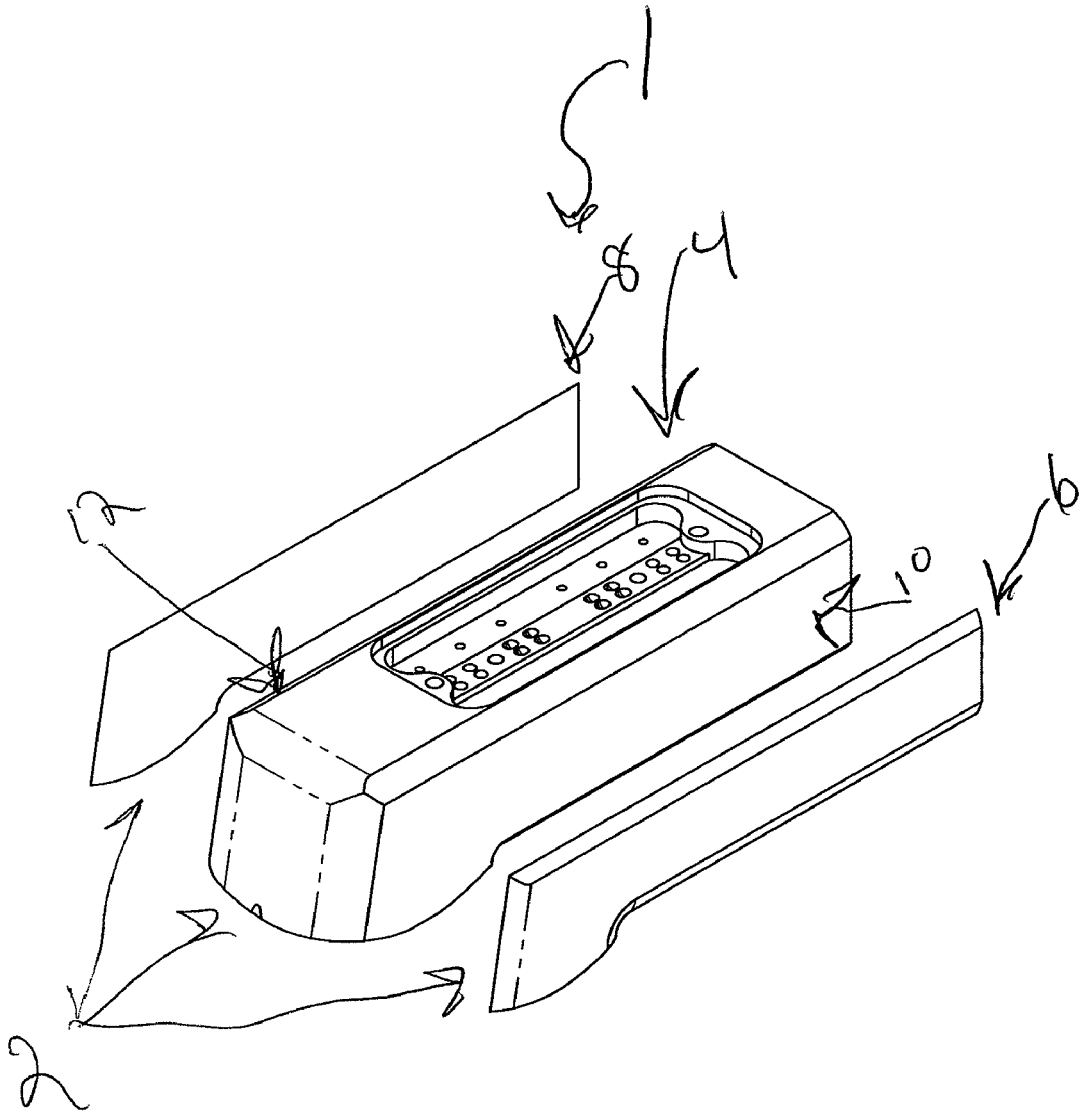
FIG. 1 is an exemplary exploded view diagram showing a bar gun with a protective cladding layer, in accordance with one embodiment of the present invention.

Certain embodiments of the present invention are directed toward a bar gun with a protective cladding layer. Such a bar gun with a protective cladding layer can be used to improve device durability, improve device ergonomics, enhance brand identification, and for novelty purposes. Embodiments of the present invention provide for the protection of the multiple layers of lamination that can be caused to separate given enough impact at one of the bond seams.

A bar gun with a protective cladding as described in the present disclosure can provide for a device with increased durability. A bar gun is typically manufactured by laminating several machined or injection molded layers together to form fluid inlets, outlets, passageways and valve bores. Valve elements and actuators may then be used to control the flow of liquids from the inlets through the valve bores, outlets and passageways, to an output nozzle. In operation in a busy bar or restaurant environment, rough handling by bartenders and wait staff may eventually cause de-lamination of the layers. The result of such de-lamination can be leaks in the bar gun requiring frequent maintenance to repair the leaks and in some cases may require replacement of the entire bar gun. A protective cladding as described herein may provide an additional level of protection against de-lamination caused by rough handling.

In addition, the protective cladding layer on a bar gun may be molded or otherwise shaped so as to provide a more comfortable feel for the operators of the device. For example, the protective cladding may be shaped with rounded form or beveled edges, thus making it more comfortable for an operator to grasp. As another example, the cladding layer may contain ridges and grooves that are shaped to be complementary to an operator's fingers, again allowing for a more comfortable grip. The increase in comfort of the operator using the device may result in reduced strain on the operator's hand, thus reducing the potential for injury.

Furthermore, bar guns with a protective cladding layer as described in the present disclosure can also present an opportunity for beverage retailers and producers to enhance brand identification. Because the cladding layer can be manufactured in one or more colors, it may be possible for retailers to choose colors for the cladding layers in order to enhance brand recognition for certain brands of beverages. For example, a retailer who distributes Coke™ products may choose a red cladding, a color that is readily associated with that brand. Similar color choices may be made for other brands. In some embodiments the branding may be for the retailer selling beverages, as opposed to the beverage manufacturer.

In addition to branding, the protective cladding may be used for novelty or entertainment purposes. In some embodiments, the protective cladding may be transparent or translucent. Coupled with a light source, such as a light emitting diode (LED) and a power supply, the protective cladding can appear to be illuminated. Such an illuminated device may attract attention to the bar gun, and may result in increased sales of beverages.

FIG. 1 is an exemplary exploded view diagram 1 showing a bar gun with a protective cladding in accordance with one embodiment of the present invention. As seen in FIG. 1, bar gun handle with a protective cladding 2 has a housing assembly 4 containing inlets, outlets, valve bores, fluid passageways and an output nozzle. A further description of bar gun handle 4 can be found with reference to FIG. 2. Bar gun with a protective cladding 1 further includes one or more protective cladding layers 6, 8. A housing assembly, as used herein, can refer to an assembly that is used with bar guns that are used to mix liquids from several sources into one beverage or those that dispense pre-mixed beverages, such as juice, wine and other dispensers, such as the assignee's PREMIX line of beverage dispensers.

Each of the protective cladding layers 6, 8 may be adhered to a side of bar gun handle 4 using any number of bonding agents. For example, protective cladding layer 6, 8 may be adhered to a side of the bar gun handle 4 using an adhesive. Other examples of bonding agents can include ultrasonic welding or a solvent. Any form of bonding agent that would allow a substantially permanent bond to be formed between protective cladding layers 6, 8 and bar gun handle 4 are contemplated.

In some embodiments, protective cladding layers 6, 8 can be substantially the same shape as a side 10, 12 of the bar gun handle 4. Furthermore, in other embodiments, protective cladding layer 6, 8 may be sized to substantially cover the side 10, 12 of the bar gun handle 4.

Figure 2:
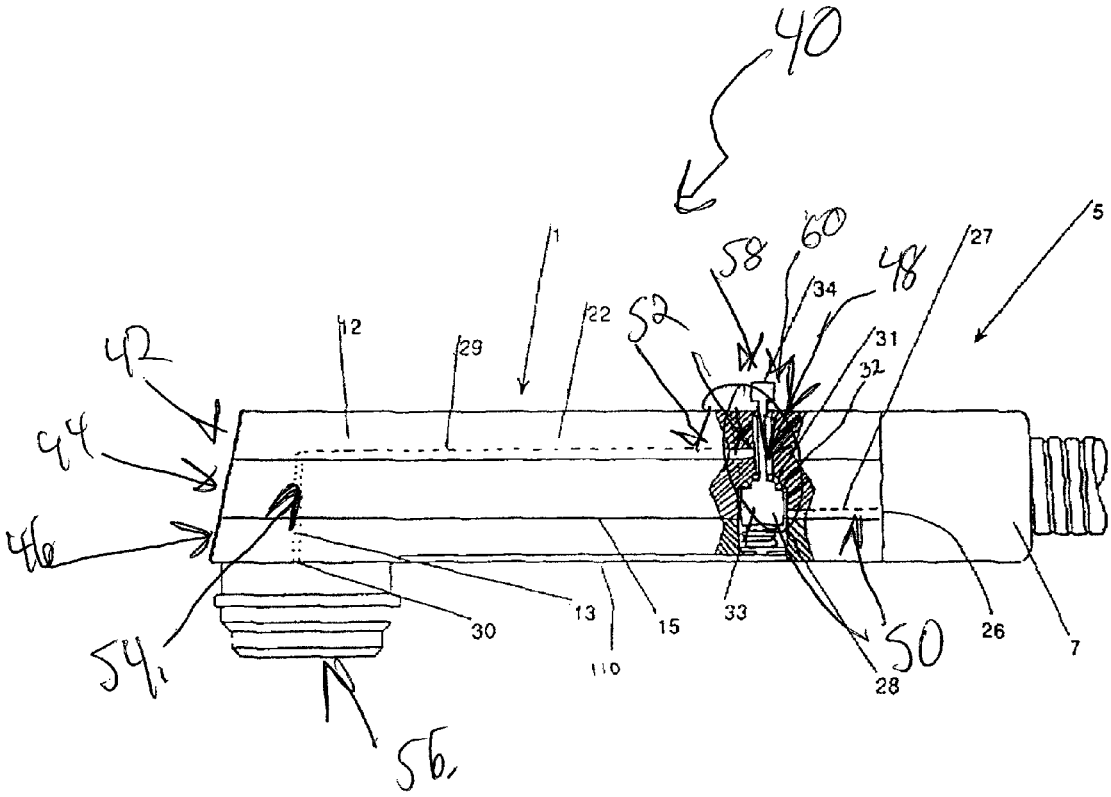
FIG. 2 is an assembled view diagram of a bar gun.

FIG. 2 is an assembled view diagram corresponding to a bar gun. In some embodiments, bar gun 40 may be made up of several layers of material, such as an acrylic. Other materials suitable for this purpose may also be used. In one exemplary embodiment, bar gun 40 may have a first layer 42, a second layer 44, and a third layer 46. Within each layer 42, 44, 46 may be formed portions of valve bores 48, fluid inlets 50, fluid outlets 52, and fluid passageways 54. Layers 42, 44, 46 may be formed through any number of techniques. One example of such a technique would be to machine the various elements described into a solid block of material. Another exemplary technique would be to form the layers 42, 44, 46 through an injection molding process.

When layers 42, 44, 46 are bonded together using known techniques such as adhesives, solvents, or ultrasonic welding, bar gun 40 may provide a path for a fluid to be communicated from the inlet 40, through the valve bore 48, to the outlet 52, and through the fluid passageway 54. The fluid can then be discharged through a nozzle 56. Typically, the discharged fluid is a beverage, such as a soft drink or water.

Furthermore, valve assembly 58 may be installed within valve bore 48 to control the flow of fluid from the input 48 to the nozzle 56. Valve actuator 60 may be used to control valve assembly 58. Although FIG. 2 depicts a single fluid path through the bar gun, a bar gun may have a plurality of fluid paths, each controlled by separate valve assemblies and actuators.

Figure 3:
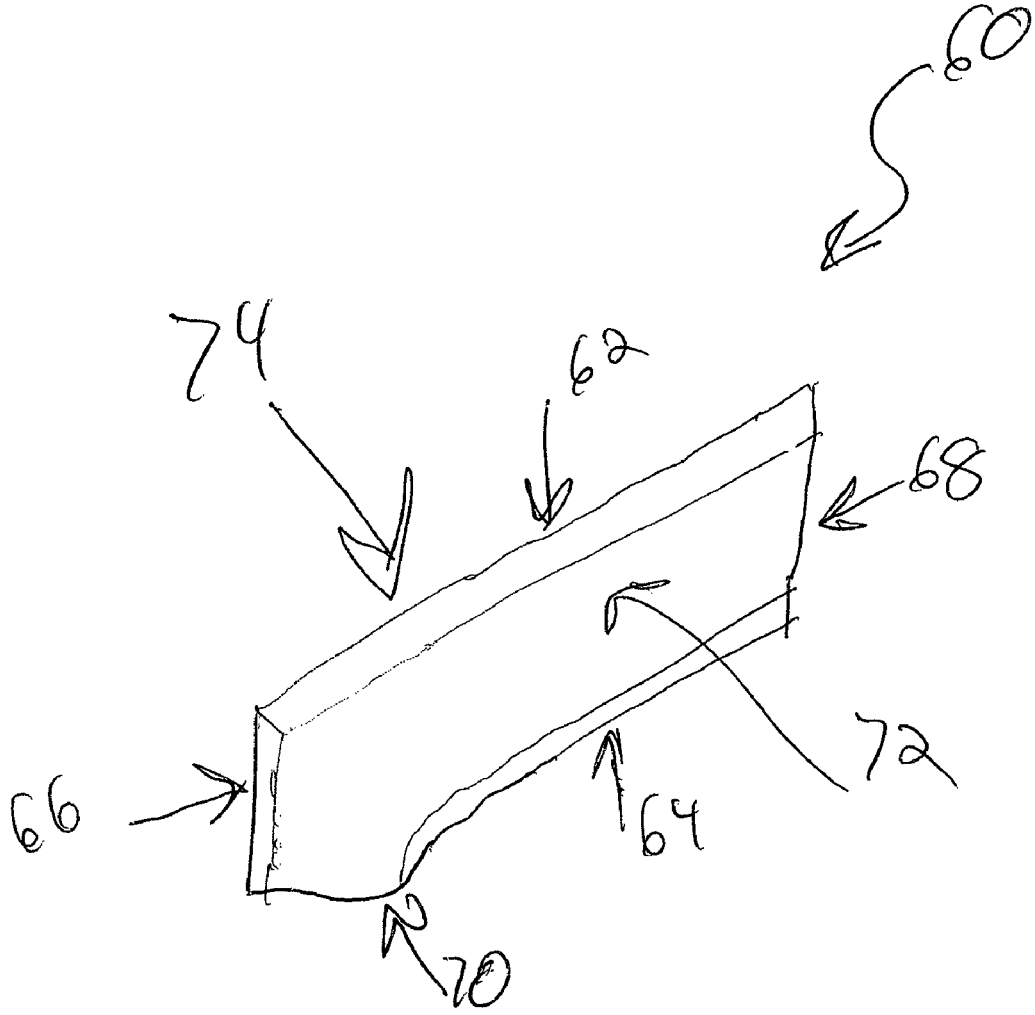
FIG. 3 is an isometric view diagram of a protective cladding layer.

FIG. 3 is an isometric view diagram of an exemplary protective cladding layer 60. Cladding layer 60 may have a top edge 62, a bottom edge 64, a front edge 66, and a rear edge 68. In some embodiments, the rear edge 68 extends from the top edge 62 to the bottom edge 64. In some embodiments, the rear edge 68 can be substantially perpendicular to the top edge 62 and the bottom edge 64. The front edge 66 of protective cladding layer 60 may extend from the top edge 62 to the bottom edge 64. In some embodiments, the front edge 66 is not substantially perpendicular to the top edge. In some embodiments, the top edge 62, bottom edge 64, front edge 66, and rear edge 68 are arranged so as to substantially conform to the shape of the bar gun handle 4.

Bottom edge 64 may have a step disposed along its edge. In some embodiments, the step is disposed substantially towards the end of the protective cladding 60 that is closer to the front edge 66. In some embodiments, the step 70 is generally arcuate in shape. In some embodiments, the step 70 is generally shaped to substantially conform to the shape of the bar gun handle 4.

Protective cladding 60 further may have a front surface 72 and a rear surface 74. In some embodiments, rear surface 74 is disposed onto the bar gun handle. In some embodiments, rear surface 74 is shaped to be complementary to the shape of the side of bar gun handle 4. Front surface 72 is generally the surface that will be gripped by an operator of the device. To increase the comfort of holding the device, in some embodiments, protective cladding 60 may increase in thickness to a constant value from rear surface 74 to front surface 72. In some embodiments, this may be accomplished by beveling or forming a radius along top edge 62 and bottom edge 64. In some embodiments, a bevel or radius may also be formed along front edge 66.

As will be understood by those skilled in the art, the present invention may be embodied in other specific forms without departing from the essential characteristics thereof. These other embodiments are intended to be included within the scope of the present invention, which is set forth in the following claims.

What is claimed is:

1. A kit for retrofitting a cladding layer onto a bar gun, comprising:

at least two cladding elements, each of said cladding elements having a top and a bottom edge, a front edge extending from said top edge to said bottom edge, a rear edge extending from said top edge to said bottom edge, an inside surface, and an outside surface, wherein each said cladding element substantially covers at least one side of said bar gun;

wherein the cladding element increases in thickness away from said top, bottom, and front edge to a constant value, said rear edge is substantially perpendicular to said top edge, said front edge is not substantially perpendicular to said top edge, and said bottom edge includes a step that is substantially arcuate; and a bonding agent, wherein said bonding agent adheres said at least two cladding element elements to said bar gun.

2. The kit of claim 1 wherein the cladding element is made of a different material than said bar gun.

3. The kit of claim 1 wherein the cladding element comprises a single, non-translucent, color.

4. A bar gun handle, comprising:

a housing assembly including at least one inlet in fluid communication with at least one valve bore, at least one outlet in fluid communication with said at least one valve bore and further in fluid communication with an output nozzle, at least one valve element operatively mounted in said at least one valve bore, and at least one actuator coupled with said at least one valve element to control a flow of fluid from said at least one inlet to said output nozzle via said valve bore; and a cladding layer disposed on at least two sides of said housing assembly, said cladding layer having a top and a bottom edge, said bottom edge including a step that is substantially arcuate, a front edge extending from said top edge to said bottom edge, said front edge being substantially non-perpendicular to said top edge, a rear edge extending from said top edge to said bottom edge, said rear edge being substantially perpendicular to said top edge, an inside surface, said inside surface disposed on said at least two sides of said housing assembly and shaped substantially complementary to said at least two sides of said housing assembly, and an outside surface, wherein said cladding layer is substantially the same shape as each of said two sides of said housing assembly, and substantially covers said two sides of said housing assembly, wherein said cladding layer comprises an opaque layer and increases in thickness away from said top, front, and bottom edges to a constant value, wherein said cladding layer is made of a different material than said housing assembly.

5. The bar gun handle of claim 4 wherein said cladding layer is made from a material selected from the group consisting of acrylic, acrylonitrile butadiene styrene, rubber, and combinations thereof.

6. The bar gun handle of claim 5 wherein said housing is made from a different material than said cladding layer.

7. The bar gun handle of claim 4 wherein said cladding layer is bonded to said housing assembly using a bonding agent selected from the group consisting of an adhesive, a solvent, an ultrasonic weld, and combinations thereof.

8. The bar gun handle of claim 4 wherein said cladding layer is shaped to have a profile with enhanced grip.

9. The bar gun handle of claim 4 wherein said cladding layer has at least one embedded light emitting diode.

* * * * *